US006922010B2

(12) United States Patent
Komatsu et al.

(10) Patent No.: US 6,922,010 B2
(45) Date of Patent: Jul. 26, 2005

(54) SHADOW MASK FOR A CATHODE RAY TUBE

(75) Inventors: Takayasu Komatsu, Tokyo-to (JP); Hirofumi Hideshima, Tokyo-to (JP); Akira Makita, Tokyo-to (JP); Yutaka Matsumoto, Tokyo-to (JP); Takuya Ogio, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/964,189

(22) Filed: Sep. 26, 2001

(65) Prior Publication Data

US 2002/0036456 A1 Mar. 28, 2002

(30) Foreign Application Priority Data

Sep. 28, 2000 (JP) ..... P2000-296133

(51) Int. Cl.[7] ..... H01J 29/80

(52) U.S. Cl. ..... 313/402; 313/403; 313/409; 445/47; 216/12; 216/25; 216/41; 216/56

(58) Field of Search ..... 313/402, 403–408; 445/47; 216/12, 25, 41, 56

(56) References Cited

U.S. PATENT DOCUMENTS 3,707,640 A * 12/1972 Lerner ..... 313/402
4,131,822 A * 12/1978 Branton ..... 313/403
5,384,511 A * 1/1995 Fujimura ..... 313/402
5,635,320 A * 6/1997 Ohtake et al. ..... 430/23
5,830,373 A * 11/1998 Ohtake et al. ..... 216/12
5,856,725 A * 1/1999 Ueda ..... 313/402
6,057,640 A * 5/2000 Aibara ..... 313/403
6,313,574 B1 * 11/2001 Banno et al. ..... 313/402
6,342,757 B1 * 1/2002 Shin et al. ..... 313/403

* cited by examiner

*Primary Examiner*—Joseph Williams
*Assistant Examiner*—Sikha Roy
(74) *Attorney, Agent, or Firm*—Ladas & Parry LLP

(57) ABSTRACT

The present invention provides a shadow mask having an improved resistance to an impact such as vibration or dropping so as to keep a constant quality of a color cathode-ray tube. The object is achieved by a shadow mask in which throughholes are formed, each of the throughholes 2*a* and 2*b* having a rear side hole portion 4*a* or 4*b* through which an electron beam enters and a front side hole portion 3*a* or 3*b* through which the electron beam is emitted so as to form a beam spot having a prescribed shape on a surface to be irradiated; wherein, each of the throughholes 2*a* and 2*b* has a ridge portion 8, 8*b* or 8*e* formed by intersection of a taper surface 10, 10*b* or 10*e* of the rear side hole portion 4*a* or 4*b* and a taper surface 6, 6*b* or 6*e* of the front side hole portion 3*a* or 3*b*; the taper size T represented by a value a half the difference between the hole width S at end 7, 7*b* or 7*e* of the front side hole portion 3*a* or 3*b* and the hole width Q at the ridge portion 8, 8*b* or 8*e* is within a range of from 30 to 40% of the thickness t of the shadow mask; and the ridge portion is formed at a sectional height of up to 35 μm from the end 9 of the rear side hole portion 4*a* or 4*b*.

2 Claims, 4 Drawing Sheets

Center portion

1

Peripheral portion

Center portion

Peripheral portion

FIG. 5 - PRIOR ART
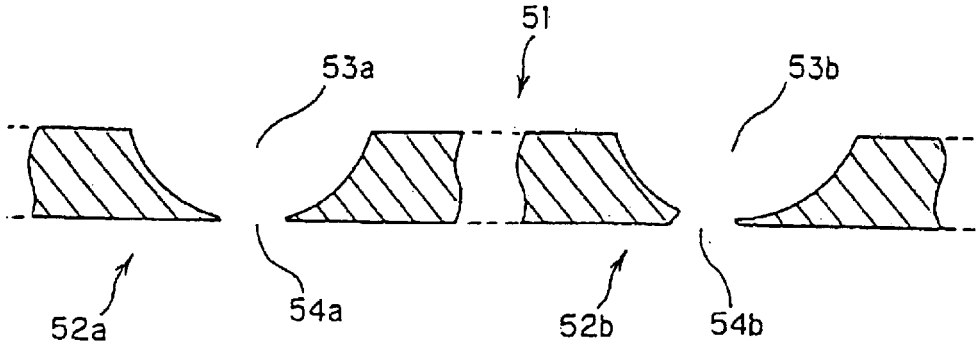

SHADOW MASK FOR A CATHODE RAY TUBE

BACKGROUND OF THE INVENTION

1. Field of the Invention

The present invention relates to a shadow mask used for a cathode-ray tube or the like, and more particularly, to a shadow mask having an improved resistance to vibration or shock.

2. Description of the Related Art

An example of a shadow mask 51 having a general structure is shown in FIG. 5 as an illustrated sectional view. Referring to FIG. 5, a shadow mask 51 is mounted on a cathode-ray tube for the purpose of forming a beam spot having a circular shape on a fluorescent surface or screen of the cathode-ray tube. Such a shadow mask 51 is formed with throughholes 52*a* and 52*b*, each having a prescribed shape, arranged in a prescribed pattern. The throughholes 52*a* and 52*b* are formed through an etching treatment of a metal thin sheet. In FIG. 5, the throughhole 52*a* is represented by a cross-sectional shape at the center portion of the shadow mask, and the throughhole 52*b*, by a cross-sectional shape at the peripheral portion of the shadow mask.

Each of the throughholes 52*a* and 52*b* is composed of rear side hole portions 54*a* and 54*b* through which an electron beam enters and a front side hole portions 53*a* and 53*b* through which the electron beam is emitted. The front side hole portions 53*a* and 53*b* are formed with an area larger than the rear side hole portion 54*a* and 54*b*. The front side hole portions 53*a* and 53*b* are formed with substantially uniform opening size and opening area irrespective of the forming positions on the shadow mask. The rear side hole portions 54*a* and 54*b* are as well formed with substantially uniform opening size and opening area. In the throughhole 52*b* on the peripheral portion of the shadow mask, the front side hole portion 53*b* is shifted toward the outer periphery of the shadow mask so that the electron beam is not shielded by a portion of the taper surface of the front side hole portion 53*b* serving as the taper surface on the outer periphery of the shadow mask 51.

When a shadow mask of the type as described above is used in a general cathode-ray tube or in a cathode-ray tube for a non-industrial TV set having a curved display screen surface, application of a dropping impact has not posed a serious problem.

However, when using the same shadow mask in a flat cathode-ray tube having a flat display screen side and a radius of curvature on the fluorescent surface side larger than the general cathode-ray tube, or when using a shadow mask having a finer pitch of throughholes or finer sizes of individual parts for achieving a higher precision in a color cathode-ray tube, a dropping impact was confirmed to cause in some cases sagging of the center portion of the shadow mask (see the broken line in FIG. 4).

In this respect, Japanese Unexamined Patent Publication No. 5-86441 discloses improving strength of a shadow mask by using a metal material having a high Young's modulus. However, since a change in the metal material itself exerts an important effect on the congeniality with the material quality and spring property of the related members such as a frame for holding the shadow mask, the inconvenience is a considerable change in materials of the related members.

SUMMARY OF THE INVENTION

The present invention was developed to solve the problems described above, and has an object to provide a shadow mask having improved resistance to impact such as vibration and dropping so as to ensure maintenance of a uniform quality of a color cathode-ray tube.

A first aspect of the present invention provides a shadow mask in which throughholes are formed, each of the throughholes having a rear side hole portion through which an electron beam enters and a front side hole portion through which the electron beam is emitted so as to form a beam spot having a prescribed shape on a surface to be irradiated; wherein, each of the throughholes has a ridge portion formed by intersection of a taper surface of the rear side hole portion and a taper surface of the front side hole portion; the taper size T (=S−Q)/2) represented by a value a half the difference between the hole width S at the end of the front side hole portion and the hole width Q at the ridge portion is within a range of from 30 to 40% of the thickness of the shadow mask; and the ridge portion is formed at a sectional height lower than the end of the rear side hole portion by up to 35 $\mu$m.

According to the invention, the taper size T represented by a value a half the difference between the hole width S at the end of the front side hole portion and the hole width Q at the ridge portion is limited within a range of from 30 to 40% of the shadow mask thickness. It is therefore possible to reduce the amount of etching of the front side hole portion formed with a large area, thereby increasing the metal portion not etched. As a result, it is possible to achieve a shadow mask having an improved resistance to an impact such as vibration or dropping. In the invention, furthermore, the ridge portion is formed with a sectional height lower than the end of the rear side hole portion by up to 35 $\mu$m. In a shadow mask having an improved resistance to an impact such as vibration or dropping, it is possible to prevent halation and to prevent light shielding on a level exceeding the necessary one of the electron beam.

According to a second aspect of the invention, in a shadow mask of the first aspect of the invention, the taper size T in the peripheral portion of the shadow mask is within a range of from 30 to 40% of the shadow mask thickness.

According to the invention in which the taper size T in the peripheral portion of the shadow mask is within a range of from 30 to 40% of the thickness, it is possible to shield electron beam in excess of the necessity upon emitting the electron beam in the shadow mask having an improved resistance to an impact such as vibration or dropping.

BRIEF DESCRIPTION OF THE DRAWINGS

FIG. 5 is a descriptive view illustrating a typical sectional shape of a general shadow mask.

DESCRIPTION OF THE PREFERRED EMBODIMENTS

Embodiments of the present invention will now be described with reference to the drawings.

Figure 1A:
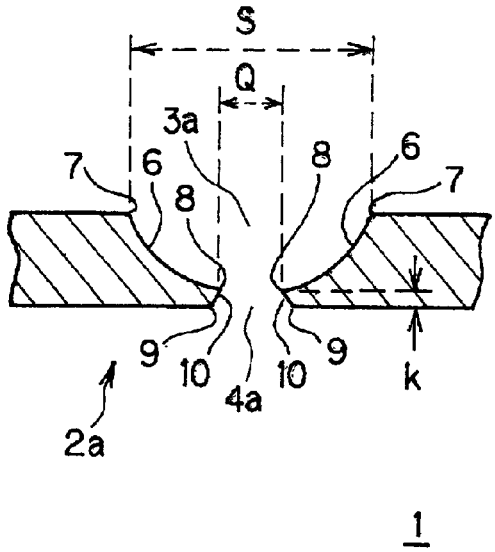
FIG. 1 give sectional views illustrating typical sectional shapes of the throughhole formed in the shadow mask of the present invention: (a) illustrates a sectional shape of the throughhole formed in the center portion of the shadow mask, and (b) illustrates a sectional shape of the throughhole formed in the peripheral portion of the shadow mask.
Figure 1B:
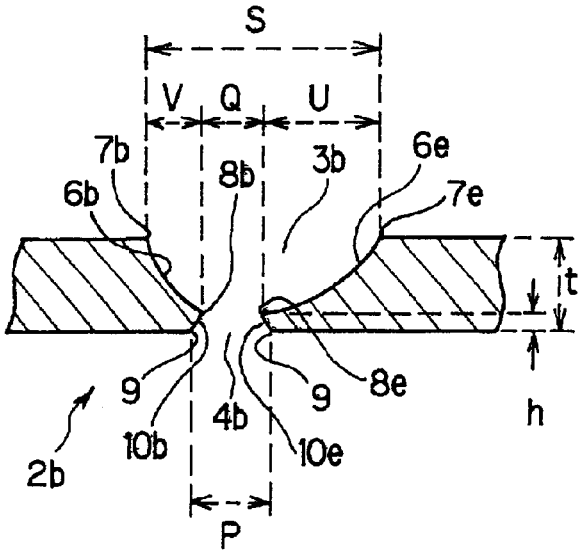
Figure 2A:
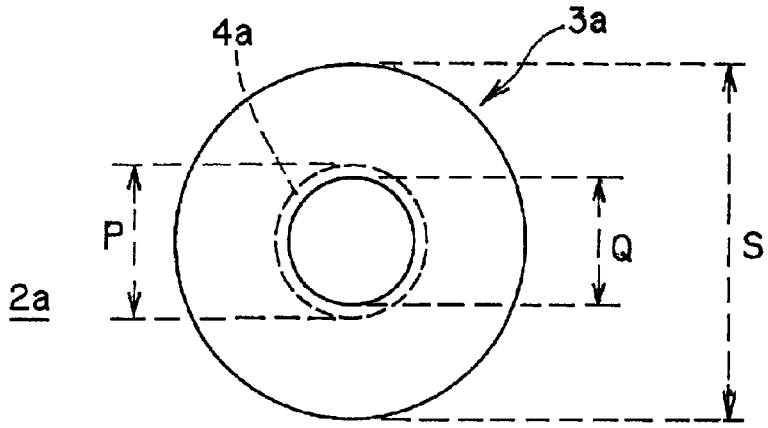
FIG. 2 is a front view illustrating typical shapes of the throughholes at various portions shown in FIG. 1.
Figure 2B:
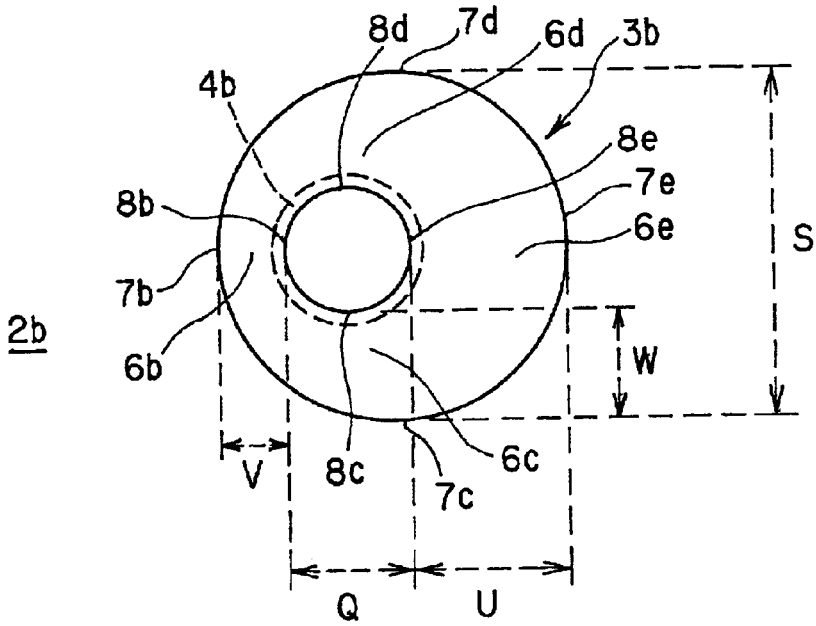
Figure 3:
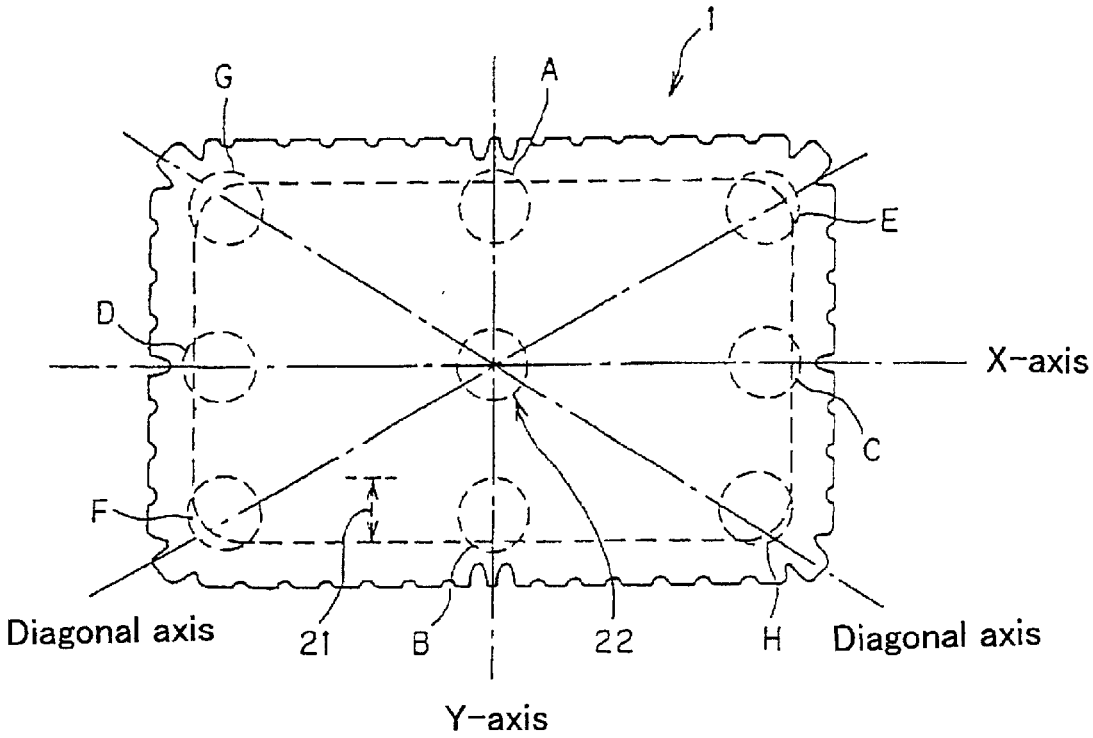
FIG. 3 is a schematic front view illustrating the positional relationship on the shadow mask.

FIG. 1 gives sectional views illustrating typical sectional shapes of the throughholes 2*a* and 2*b* formed in the shadow mask of the invention: (a) illustrates a sectional shape of the throughhole 2*a* formed in the center portion of the shadow mask, and (b) illustrates a sectional shape of the throughholes formed in the peripheral portion of the shadow mask; FIG. 2 is a front view illustrating typical shapes of the throughholes 2*a* and 2*b* at various portions shown in FIG. 1; and FIG. 3 is a schematic front view illustrating the positional relationship of the throughholes formed at various portions of the shadow mask 1.

In the shadow mask 1 of the invention, throughholes of a prescribed shape are formed in a prescribed pattern by etching a metal sheet. The pattern is usually based on an arrangement of the throughholes in substantially a closest packed structure or a structure approximate thereto. The shadow mask 1 having the shape as described above is attached to a cathode-ray tube, and is used for forming a beam spot of a prescribed shape on the fluorescent surface of the cathode-ray tube. The shape of the beam spot may be circular or a substantially rectangular slot shape. The technical idea of the invention is applicable to any of the cases. In the case of a slot shape, the technical idea of the invention is applicable to the width size in the shorter side (i.e., X-axis direction) of the slot. In the following description, a shadow mask having a circular beam spot formed thereon will be explained.

The front shape of the throughhole will first be described.

As shown in FIGS. 1 and 2, the throughholes 2*a* and 2*b* comprise rear side hole portions 4*a* and 4*b* through which an electron beam enters, and front side hole portions 3*a* and 3*b* through which the electron beam is emitted. The front side hole portions 3*a* and 3*b* are formed with an area larger than that of the rear side hole portions 4*a* and 4*b*. These throughholes 2*a* and 2*b* can shield the electron beam partly by means of ends 9 or taper surfaces 10 of the rear side hole portions 4*a* and 4*b*, and form a circular beam spot of a prescribed size at a prescribed position on a fluorescent surface of the cathode-ray tube.

The positional relationship between the front side hole portions 3*a* and 3*b* and the rear side hole portions 4*a* and 4*b* composing the throughholes 2*a* and 2*b* differs between the peripheral portion 21 and the center portion 22 of the shadow mask 1 shown in FIG. 3. For example, in the center portion 22 of the shadow mask 1, where the electron beam is irradiated substantially straight toward the shadow mask 1, the center position of the rear side hole portion 4*a* almost agrees with the center position of the front side hole portion 3*a*. In the peripheral portion 21 of the shadow mask 1, on the other hand, the electron beam is diagonally irradiated toward the shadow mask 1. The front side hole portion 3*b* of the throughhole 2*b* is formed so as to shift toward the outer peripheral side of the shadow mask relative to the rear side hole portion 4*b* at positions A to H (see FIG. 3) when the throughhole 2*b* is formed. Furthermore, according as the position of formation of the throughhole 2*b* comes from the center portion 22 to the peripheral portion 21, the front side hole portion 3*b* of the throughhole 2*b* gradually shifts toward the outer peripheral side of the shadow mask relative to the rear side hole portion 4*b*.

By adopting the positional relationship as described above, it is possible to form a circular beam spot of a prescribed size at a prescribed position on the fluorescent surface of the cathode-ray tube. The term the center portion 22 of the shadow mask 1 as used herein means a portion including the center of the shadow mask 1, as shown in FIG. 3. The peripheral portion 21 of the shadow mask 1 is a portion containing the outer peripheral portion typically represented by A to H, and means a range including a portion from the outermost throughhole to about 20 mm in side.

The sectional shape of the throughhole will now be described.

In the invention, in the throughholes 2*a* and 2*b* formed in the shadow mask, the taper size T (=(S−Q)/2) represented by a value a half the difference between the hole width S at ends 7, 7*b*, . . . , 7*e* of the front side hole portions 3*a* and 3*b* and the hole width Q at the ridge portions 8, 8*b*, . . . , 8*e* is limited within a range of from 30 to 40% of the shadow mask thickness t, and the ridge portions 8, 8*b*, . . . , 8*e* are formed with a sectional height k, h of up to 35 μm from the ends 9 of the rear side hole potions 4*a* and 4*b*, thereby achieving the planned object. The term "ridge portions" as used herein means an intersecting portions which are formed by taper surfaces 10, 10*b*, . . . , 10*e* of the rear side hole portion 4*a* and 4*b* crossing the taper surfaces 6, 6*b*, . . . , 6*e* of the front side hole portions 3*a* and 3*b*, and the term "hole width Q" means the diameter of a hole usually surrounded by the ridge portions.

The taper size T is expressed as an average value over values for the individual portions of the taper surfaces 6, 6*b*, . . . , 6*e* of the front side hole portions 3*a* and 3*b*. More specifically, because the ridge portion 8 is formed at the center of the throughhole 2*a* in the center portion 22 shown in FIGS. 1(*a*) and 2(*a*), the taper size T represented by the taper surface 6 of the front side hole portion 3*a* is uniform for all the portions of the taper surface 6. However, in the throughhole 2*b* of the peripheral portion 21 shown in FIGS. 1(*b*) and 2(*b*), the ridge portion 8 is formed at a position shifting from the center of the throughhole. The taper size T represented by the taper surfaces 6*b*, . . . , 6*e* of the front side hole portion 3*b* is not uniform for the various portions of the taper surface.

In the invention, by limiting the taper size T within a range of from 30 to 40% of the shadow mask thickness t, it is possible to improve shadow mask strength against vibration or impact. The reason is that limiting the taper size within the aforementioned range causes an increase in the metal contents in the front side hole portions 3*a* and 3*b* and brings about a higher strength.

With a taper size T of under 30% of the thickness t, the opening area of the front side hole portions 3*a* and 3*b* becomes smaller, making it difficult for the electron beam to pass through, and manufacture itself of throughholes having such a taper size T becomes difficult. With a taper size T of over 40% of the thickness t, on the other hand, the opening area of the front side hole portion becomes larger, resulting in an increase in the opening area of the front side hole portions 3*a* and 3*b*, making it impossible to achieve a sufficient strength of the shadow mask.

In the invention, furthermore, the ridge portions 8, 8*b*, . . . , 8*e* are formed with a sectional height k, h of up to 35 μm from the ends 9 of the rear side hole portions 4*a* and 4*b*. This permits inhibition of reflection of the electron beam on the taper surfaces 10, 10*b*, . . . , 10*e* of the rear side hole portions 4*a* and 4*b*, and prevention of halation. In addition, since shielding of the electron beam to an extent exceeding a necessary level can be avoided, it is possible to cause a beam spot of a desired shape to land on the fluorescent surface of the cathode-ray tube.

With a sectional height k, h of over 35 μm, the electron beam may be reflected on the taper surface 10*e* of the rear side hole portion 4*b* up to the ridge portion 8*e*, particularly in the peripheral portion 21 of the shadow mask. In the manufacturing process, reduction in size of the front side hole portions 3*a* and 3*b* makes it difficult for the electron beam to pass through. The electron beam tends to be easily shielded by the taper surface 10*e* of the rear side hole portions 4*a* and 4*b*, and this may result in deformation of the beam sport shape. Considering smoothness of manufacture, the lower limit of the sectional height k, h up to the ridge portions 8, 8*b*, . . . , 8*e* should preferably be 10 μm.

Forming should preferably be accomplished so that the taper size T of the shadow mask in the peripheral portion 21 thereof is within a range of from 30 to 40% of the shadow mask thickness t. The throughholes formed to have such a taper size T should preferably include at least ones formed at a position of 20 mm inside the position of the throughhole formed on the outermost periphery. This permits exclusion of factors on the front side hole portions 3*a* and 3*b* side which affect passage of the electron beam. The resultant shadow mask is excellent in impact resistance, free from halation and can cause a desired electron beam spot to land on the fluorescent surface.

The thus formed shadow mask 1 has a relatively increase metal contents in the peripheral portion 21 thereof, resulting in a higher strength. As a result, the center portion 22 of the shadow mask is supported by the peripheral portion 21 having become relatively heavier and stronger. Even in application of a stress such as a dropping impact after mounting on a cathode-ray tube, therefore, no deformation such as a dent is caused in the shadow mask 1.

The aforementioned relationship is applicable, irrespective of the specifications for the shadow mask such as the shadow mask size and the size and shape of the throughholes. The above-mentioned ranges are more suitably applicable for shadow masks for cathode-ray tubes within a range of from 17 to 21 inches. Unless otherwise specified, the term the "sectional height" as hereafter used shall mean the height from the ends 9 of the rear side hole portions 4*a* and 4*b* to the ridge portions 8, 8*b*, . . . , 8*e*. For the throughhole 2*b* in the peripheral portion 21 of the shadow mask, it is represented by the "sectional height h", and for the throughhole 2*a* in the center portion 22 of the shadow mask, it is expressed by the "sectional height k".

A typical manufacturing method of the shadow mask explained above will now be described. It is needless to mention that the shadow mask of the invention is not limited to the following manufacturing method.

The shadow mask 1 can be formed by a conventionally known method. The shadow mask is formed through the steps of photo-etching and manufactured through a continuous inline apparatus. For example, a water-soluble colloidal photo-resist or the like is coated onto the both surfaces of an invar material (iron-nickel alloy material) having a thickness t of about 0.13 mm, and dried. Subsequently, a photo-mask having a shape pattern of the front side hole portions 3*a* and 3*b* as described above is brought into close contact with the coated surface, and a photo-mask having a shape pattern of the rear side hole portions 4*a* and 4*b* is brought into close contact with the back thereof. The same is exposed to ultraviolet-rays through means such as high-pressure mercury, and developed with water. The positional relationship and the shape of the photo-mask having the pattern of the front side hole portions 3*a* and 3*b* formed thereon and the photo-mask having the pattern of the rear side hole portions 4*a* and 4*b* formed thereon are designed and arranged in response to the positional relationship between the front side hole portions 3*a* and 3*b* and the rear side hole portions 4*a* and 4*b* formed and the size thereof. The exposed portions of the metal of which the surroundings are covered with a resist film image are formed into the individual shapes as described above on the basis of the differences in the etching rate between portions. Etching is usually accomplished by two-stage etching comprising a first etching step for applying half-etching by spraying ferric chloride solution from the both sides after a heat treatment, and a second etching step for filling the holes on one side of the half-etched holes of the both sides and then etching again the holes on the other side, thereby forming the throughholes. Subsequently, the shadow mask is manufactured by continuously conducting post-steps such as water rinsing and stripping.

Particularly in the invention, the aforementioned dimensions including the hole width S at ends of the front side hole portions 3*a* and 3*b*, the hole width Q at the ridge portion, the sectional height k, h of the ridge portion, the material and the thickness of the metal sheet can be adjusted with the above-mentioned preferable ranges by changing the etching mask pattern and the etching conditions while considering these dimensions. These dimensions can be adjusted by arbitrarily setting the first etching conditions and the second etching conditions. More specifically, the etching conditions include the etching solution temperature, the viscosity thereof, the jet pressure, the selection on the filling side, and the like.

The manufactured shadow mask is processed by press into a prescribed shape, and then, subjected to an optical surface blackening treatment. This optical surface blackening is applied for the purpose of preventing occurrence of secondary electrons, heat radiation or rust production, and is effective particularly for improving corrosion resistance.

Figure 4:
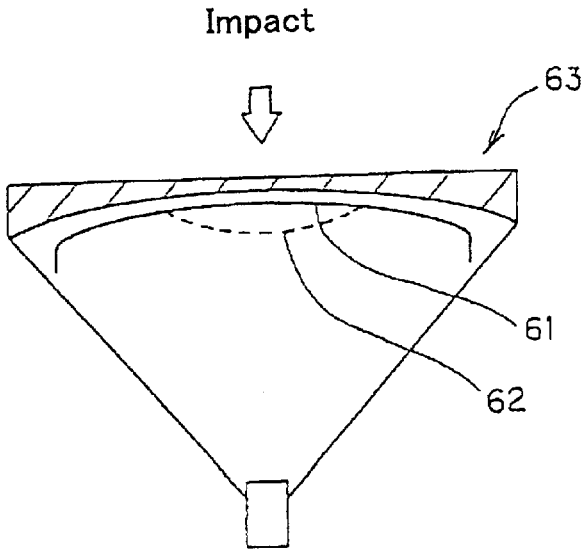
FIG. 4 is a descriptive view illustrating an embodiment in which the shadow mask is mounted on a flat type cathode-ray tube.

Embodiments in which the shadow mask of the invention is mounted on a cathode-ray tube will now be described. FIG. 4 is a descriptive view illustrating an embodiment in which the shadow mask is mounted on a flat type cathode-ray tube 63. In FIG. 4, a solid line represent the shadow mask 61 of the invention after application of a cropping impact or the like, and a broken line represents the conventional type shadow mask 62 after occurrence of a dent by application of a dropping impact or the like.

The shadow mask 61 of the invention can suitably be used in a flat type cathode-ray tube 63 of which the front side is more flat than in a general cathode-ray tube and the fluorescent surface has a larger radius of curvature. Even after application of a dropping impact or the like, there never occurs a deformation such as a dent of the center portion of the shadow mask 61.

EXAMPLES

An example and a comparative example will be presented to describe the present invention further in detail.

Example 1

An invar material (iron-nickel alloy) having a thickness of 0.13 mm was used. After degreasing the both sides of this sheet material with a 1% aqueous sodium hydroxide solution, a photosensitive resist comprising an aqueous ammonium dichromate—casein solution was coated onto the both surfaces into a thickness of 7 μm, and dried. A glass pattern for exposure comprising a front side hole diameter of 107 μm, a rear side hole diameter of 72.5 μm and a throughhole pitch of 0.23 mm was brought into close contact therewith, and was exposed to ultraviolet rays. After developing with water at 30° C., a heat burning was applied at 200° C.

The throughholes were pierced by a two-stage etching process. A first etching step was conducted to apply half-etching to the both surfaces of the sheet. The first etching step was accomplished by spraying ferric chloride solution of 47 Baume at 74° C. under a prescribed spraying pressure (0.54 MPa for the front side hole portion and 0.25 MPa for the rear side hole portion). Then, the half-etched holes on the front hole portion side were filled with a hot-melt material having an etching solution resistance, and then, a second etching step was carried out to form throughholes. The second etching step was accomplished by spraying a ferric chloride solution of 49 Baume at 65° C. from the rear hole portion side under a spraying pressure of 0.34 MPa.

Then, the photosensitive resist and the hot-melt material were stripped off and dissolved with an aqueous sodium hydroxide solution, water-rinsed and dried, thereby manufacturing a shadow mask of Example 1.

Dimensions of the throughholes of the resultant shadow mask included a hole width S of 196 $\mu$m at ends of the front side hole portions 3*a* and 3*b*, a hole width Q of 107 $\mu$m at the ridge portion, a sectional height k, h of 34 $\mu$m, and a taper size T (=(S−Q)/2) of 44.5 $\mu$m which represented 34.2% of the thickness t. A single shadow mask had a weight of 79.6 g.

Comparative Example 1

A shadow mask of Comparative Example 1 was manufactured in the same manner as in the aforementioned Example 1. In Comparative Example 1, the first etching conditions and the second etching conditions were changed as follows. The first etching step was carried out by spraying a ferric chloride solution of 49 Baume at 70° C. under a prescribed spraying pressure (0.39 MPa for the front side hole portion, and 0.49 MPa for the rear side hole portion). The second etching step was conducted by spraying a ferric chloride solution of 47 Baume at 62° C. under a spraying pressure of 0.34 MPa from the front hole portion side.

Dimensions of the throughholes of the resultant shadow mask included a hole width S of 216 $\mu$m at ends of the front side hole portions 3*a* and 3*b*, a hole width Q of 109 $\mu$m at the ridge portion, a sectional height k, h of 34 $\mu$m, and a taper size T (=(S−Q)/2) of 53.5 $\mu$m which represented 41.2% of the thickness t. A single shadow mask had a weight of 74.6 g.

Each of the shadow masks obtained in Example 1 and Comparative Example 1 was press-formed and mounted on a cathode-ray tube. A drop resistance test was carried out on this cathode-ray tube to observe deformation of the shadow mask. While the shadow mask of Example 1 showed no deformation, the shadow mask obtained in Comparative Example 1 showed a deformation.

According to the shadow mask of the present invention, as described above, the amount of etching of the front side hole portion formed with a large area is reduced to increase the metal content by forming throughholes having a prescribed taper size T. It is therefore possible to obtain a shadow mask having an improved resistance to an impact such as vibration, dropping or the like. In the invention, a shadow mask excellent in impact resistance and permitting landing of a desired electron beam spot on the fluorescent surface by limiting the sectional height up to the ridge portion and the taper size T at peripheral portion of the shadow mask within prescribed ranges.

A cathode-ray tube provided with this shadow mask can keep a high image quality even against vibration or impact during transportation and distribution of the products.

What is claimed is:

1. A shadow mask in which throughholes are formed, each of said throughholes having a rear side hole portion through which an electron beam enters and a front side hole portion through which the electron beam is emitted so as to form a beam spot having a prescribed shape on a surface to be irradiated;

wherein, each of said throughholes has a ridge portion formed by intersection of an inwardly tapered surface of said rear side hole portion and a taper surface of said front side hole portion;

wherein each of the throughholes at the front and rear side hole portions is circularly shaped;

wherein the front side portion of the throughholes, except the throughholes at the center portion of the shadow mask, is gradually shifted toward the outer peripheral side of the shadow mask relative to the rear side hale portion;

the taper size T (=(S−Q)/2) as an average value of the individual portions of the taper surfaces which is represented by a value a half the difference between the hole width S at the end of said front side hole portion and the hole width Q at said ridge portion is within a range of from 30 to 40% of the thickness of said shadow mask; and said ridge portion is formed at a sectional height of up to 35 $\mu$m from the end of said rear side hole portion.

2. A shadow mask according to claim 1, wherein the taper size T as en average value of the individual portions of the taper surfaces in a peripheral portion of said shadow mask is within a range of 30 to 40% of the thickness of said shadow mask.

* * * * *